US008051505B1

(12) United States Patent
Horton

(10) Patent No.: US 8,051,505 B1
(45) Date of Patent: Nov. 8, 2011

(54) SPA COVER AND METHOD

(76) Inventor: Karl G. Horton, Greensboro, NC (US)

( * ) Notice: Subject to any disclaimer, the term of this patent is extended or adjusted under 35 U.S.C. 154(b) by 889 days.

(21) Appl. No.: 12/080,298

(22) Filed: Apr. 2, 2008

(51) Int. Cl.
*E04H 4/00* (2006.01)

(52) U.S. Cl. ..... 4/498; 4/503

(58) Field of Classification Search ..... 4/494, 498, 4/503, 546, 557; 135/95, 117, 120.2, 20.2; 52/79.6, 82
See application file for complete search history.

(56) References Cited

U.S. PATENT DOCUMENTS 3,395,777 A * 8/1968 Rodosta ..... 187/213
4,598,506 A * 7/1986 Nohl et al. ..... 52/66
5,860,464 A * 1/1999 Schon ..... 160/84.06
6,017,131 A * 1/2000 Goins ..... 362/249.11
6,718,566 B1 * 4/2004 Wilson ..... 4/498

* cited by examiner

*Primary Examiner* — Gregory Huson
*Assistant Examiner* — Erin Deery

(57) ABSTRACT

A cover for a spa includes a frame with a raisable hood. The hood is affixed by cable to an electric winch mounted atop the frame. Pivotable louvers allow the hood to raise and bracket guides act as stops for safety purposes. After spa usage the winch lowers the spa hood to cover the spa and prevent dust, leaves, debris and the like from contaminating the water contained within.

8 Claims, 4 Drawing Sheets

SPA COVER AND METHOD

FIELD OF THE INVENTION

The invention herein pertains to covers for spas and particularly pertains to a hood which is raised and lowered by an electric winch.

DESCRIPTION OF THE PRIOR ART AND OBJECTIVES OF THE INVENTION

Spas, hot tubs and pools have become increasingly popular with home owners in recent years. Spas and hot tubs are usually covered during periods of inactivity to prevent dust and debris from contaminating the water contained therein as spas and hot tubs do not generally have the maintenance or filtering systems associated with larger in-ground swimming pools. Typical manual spa covers are heavy and awkward for an individual to install and remove. Consequently, automated spa covers are becoming more accepted such as that shown in U.S. Pat. No. 6,718,566. Certain prior art spa covers are often difficult to manipulate while others are not economical to purchase and operate.

Therefore, in view of the problems and disadvantages associated with prior art spa covers, the present invention was conceived and one of its objectives is to provide an electrically operated spa cover which can be easily installed and removed as needed by both adults and children.

It is another objective of the present invention to provide a spa cover which is safe and convenient to operate.

It is still another objective of the present invention to provide a spa cover which is relatively inexpensive to purchase and maintain.

It is yet another objective of the present invention to provide a spa cover which includes an electric winch and hood for rapid installation and removal.

Various other objectives and advantages of the present invention will become apparent to those skilled in the art as a more detailed description is set forth below.

SUMMARY OF THE INVENTION

The aforesaid and other objectives are realized by providing a spa cover which can be constructed to accommodate various standard spas, hot tubs, small swimming pools and the like. The spa cover includes a frame with a movable spa hood which is raised and lowered by an electric winch mounted atop the frame. A cable is affixed to the winch and to the spa hood. The frame comprises a series of vertical posts which surround the spa. The spa hood is sized to completely cover the spa and includes a plurality of brackets one on each corner which surround the posts to guide and stabilize the hood during raising and lowering. During use, the winch is activated causing the cable to be wound by the winch in turn raising the hood. A pivotable louver is affixed to each side of the frame. Biased bracket guides on the louvers engage the hood brackets as the hood is raised, forcing the louvers to pivot in an outward direction thus allowing the brackets to pass by the bracket guides. The louvers return to their normal vertical position thereafter and the bracket guides then act as stops should the winch cable fail protecting anyone in the spa. To lower the hood a drive louver system is employed which is operated by an electric motor having a pinion affixed to the motor shaft. As the motor shaft turns, a rack on a drive wheel causes the drive wheel to rotate which operates linkages causing the louvers to simultaneously pivot outwardly and allow the hood brackets to pass downwardly thereby as the cable from the winch is unwound and the hood is lowered to cover the spa. A control panel positioned on one of the vertical posts allows easy and convenient operation of the louver drive and hood winch by an adult or a child. Lights are positioned on the posts to provide illumination during nighttime use. Spring loaded pull curtains joined to the louvers provide additional privacy. An alternate embodiment of the spa cover does not include pull curtains.

The method of operation describes the winch motor activation to raise and lower the hood while the electric louver motor is operated during the hood lowering process.

DETAILED DESCRIPTION OF THE PREFERRED EMBODIMENT AND OPERATION OF THE INVENTION

Figure 1:
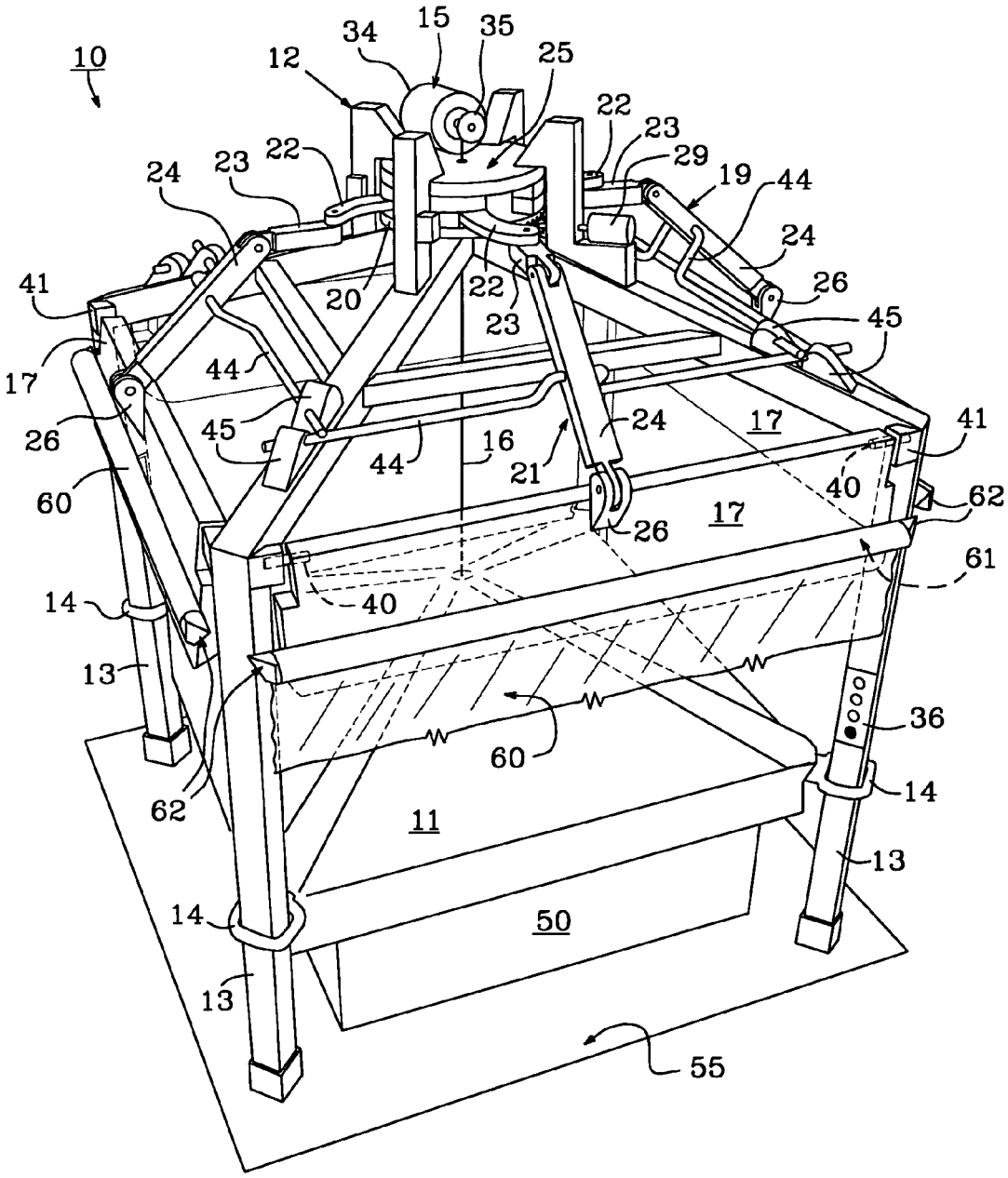
FIG. 1 demonstrates a perspective view of the preferred spa cover of the invention with the hood lowered over the spa.

For a better understanding of the invention and its operation, turning now to the drawings, FIG. 1 illustrates preferred spa cover 10 mounted on a typical floor or deck 55 over spa 50. As would be understood spa cover 10 could also be mounted in a yard, inside a sunroom, gymnasium or other desired inside or outside location for a spa. Post mount 31 and spikes 32 (FIG. 2) are optional and allow posts 13 to be positioned on a variety of surfaces such as in soil or on uneven deck floors. Spikes 32 can be exchanged for bolts (not shown) if mounted on a deck whereas spikes 32 may be nails or take the form of long stakes if mounted outdoors such as in the ground. While spa 50 depicted herein is a standard spa, spa cover 10 can accommodate various custom built spas, hot tubs, swimming pools and the like.

Figure 2:
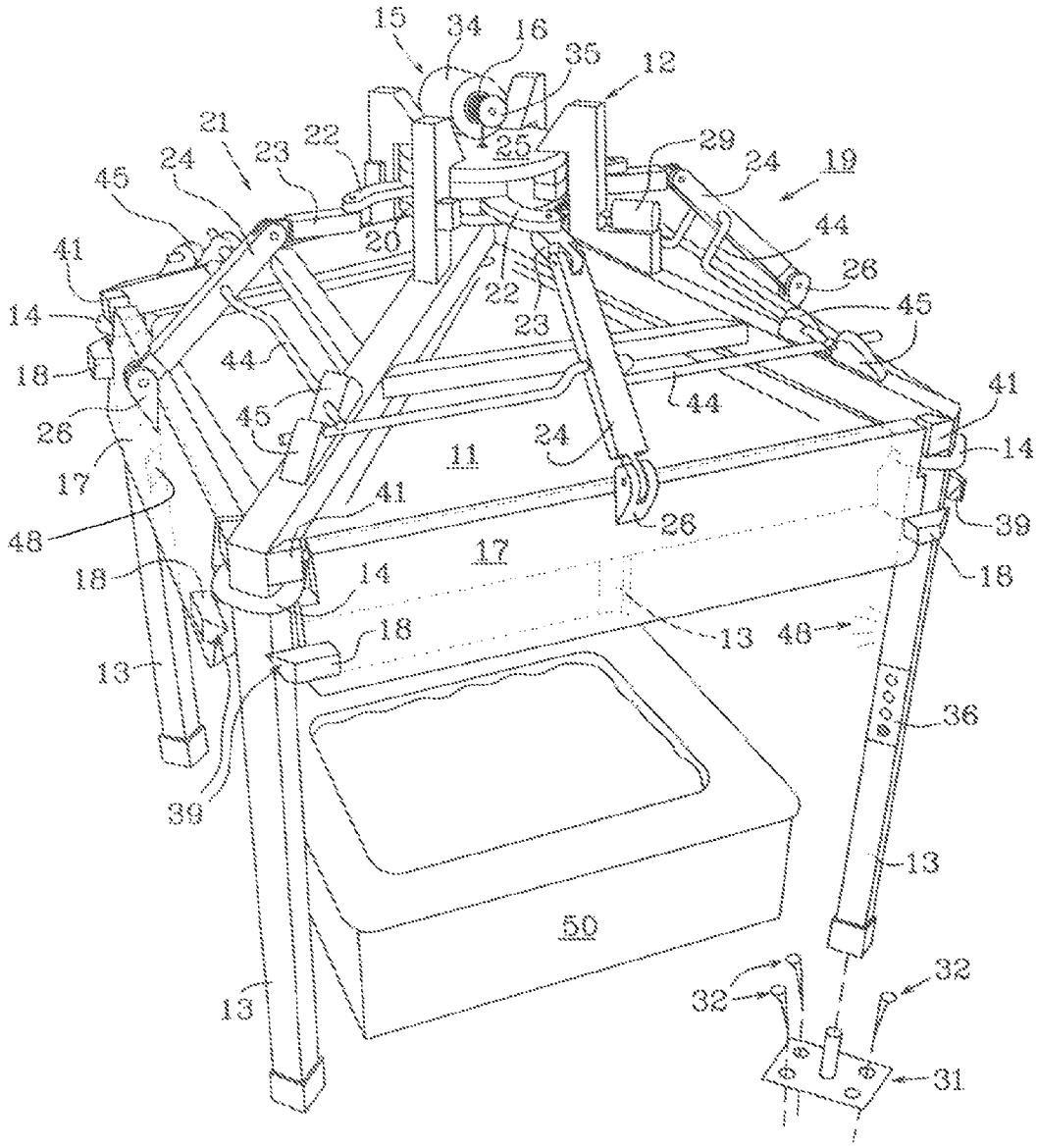
FIG. 2 illustrates an alternate embodiment of the spa cover as seen in FIG. 1 with the hood raised.

FIG. 1 further depicts spa cover 10 with hood 11 in a lowered or closed position as compared to FIG. 2 which shows hood 11 in a raised or open position on an alternate embodiment. As also shown in FIG. 1, hood 11 is attached to cable 16 which is wound by electric winch 15 atop hood frame 12. Hood frame 12 supports louver drive 19 and vertical posts 13 which support louvers 17. While four (4) such posts 13 are shown in the preferred embodiment, more posts 13 could be employed if required, for example for a large swimming pool. As seen in FIG. 2, posts 13 include lights 48 positioned thereon to provide illumination during nighttime use. As would be further understood, louvers 17 are positioned on frame 12, as shown in FIGS. 1 and 2, mounted between posts 13. Louver axles 40 in FIGS. 1 and 4 are contained within louvers 17 and continue into post bearings 41. Louver axles 40 thus allow louvers 17 to pivot outwardly during the raising and lowering of hood 11. Winch motor 34 of winch 15 turns winch pulley 35 winding cable 16 thereon through aperture 51 (FIG. 3) in drive wheel plate 25 which raises hood 11 to an elevated posture as shown in FIG. 2. Control panel 36 positioned on front post 13 as seen in FIGS. 1 and 2 allows the operator to control winch 15 during operation of hood 11 from the closed or lowered position as shown in FIG. 1 to the elevated or raised position as shown in FIG. 2. Hood 11 includes brackets 14 at each corner thereof which surround posts 13 and assist in guiding and stabilizing hood 11 during operation. Bracket guides 18 positioned on louvers 17 in FIGS. 2 and 4 each include a biased bottom surface 39 which engages brackets 14 during the ascent of hood 11. As hood 11 is raised brackets 14 contact biased bottom surfaces 39 of bracket guides 18 and urge louvers 17 to pivot outwardly as hood 11 ascends thereby allowing brackets 14 to pass or slide by bracket guides 18. Once brackets 14 are clear of bracket guides 18 as shown in FIGS. 2 and 4, louvers 17 then pivot in an opposite direction along louver axles 40 to again assume a vertical position against posts 13. With hood 11 fully raised, brackets 14 come to rest slightly above bracket guides 18, proximate post bearings 41 (FIG. 4) which also act as stops to prevent hood 11 from further raising. Should cable 16 fail while hood 11 is in a raised position, possibly causing an inadvertent descent of hood 11, brackets 14 will contact bracket guides 18 which act as safety stops whereby brackets 14 will come to rest on bracket guides 18 stopping hood 11 from further descent to protect spa users below.

In the preferred embodiment seen in FIG. 1, (fragmented) curtains 60 which are mounted on louvers 17 each include a spring loaded curtain rod 61 which allows curtain 60 to be wound thereon. Thus, self winding curtain 60 can be raised or lowered, depending on the privacy desired by users of spa 50. Curtain rods 61 include ends 62 which extend beyond louvers 17. Ends 62 act as stops and are formed similar to bracket guides 18 having biased bottom surfaces as explained above regarding preferred spa cover 10 shown in FIG. 1. A conventional electric powered curtain rod (not seen) could also be installed in place of a spring loaded curtain rod 61. Electric powered curtain rods would be operated from control panel 36.

Figure 3:
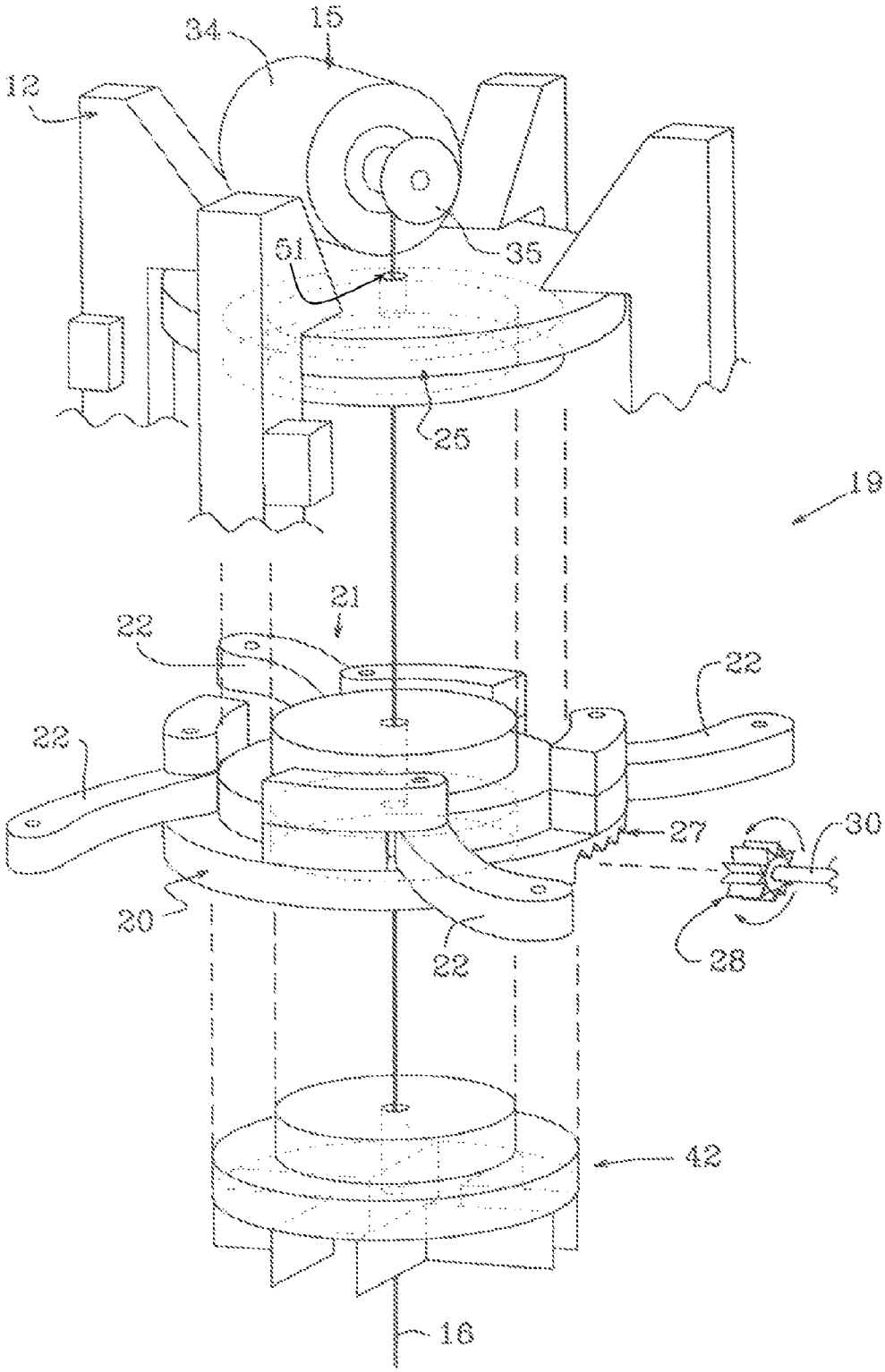
FIG. 3 shows an enlarged view of the louver drive wheel, drive plate and drive base exploded from the fragmented frame.
Figure 4:
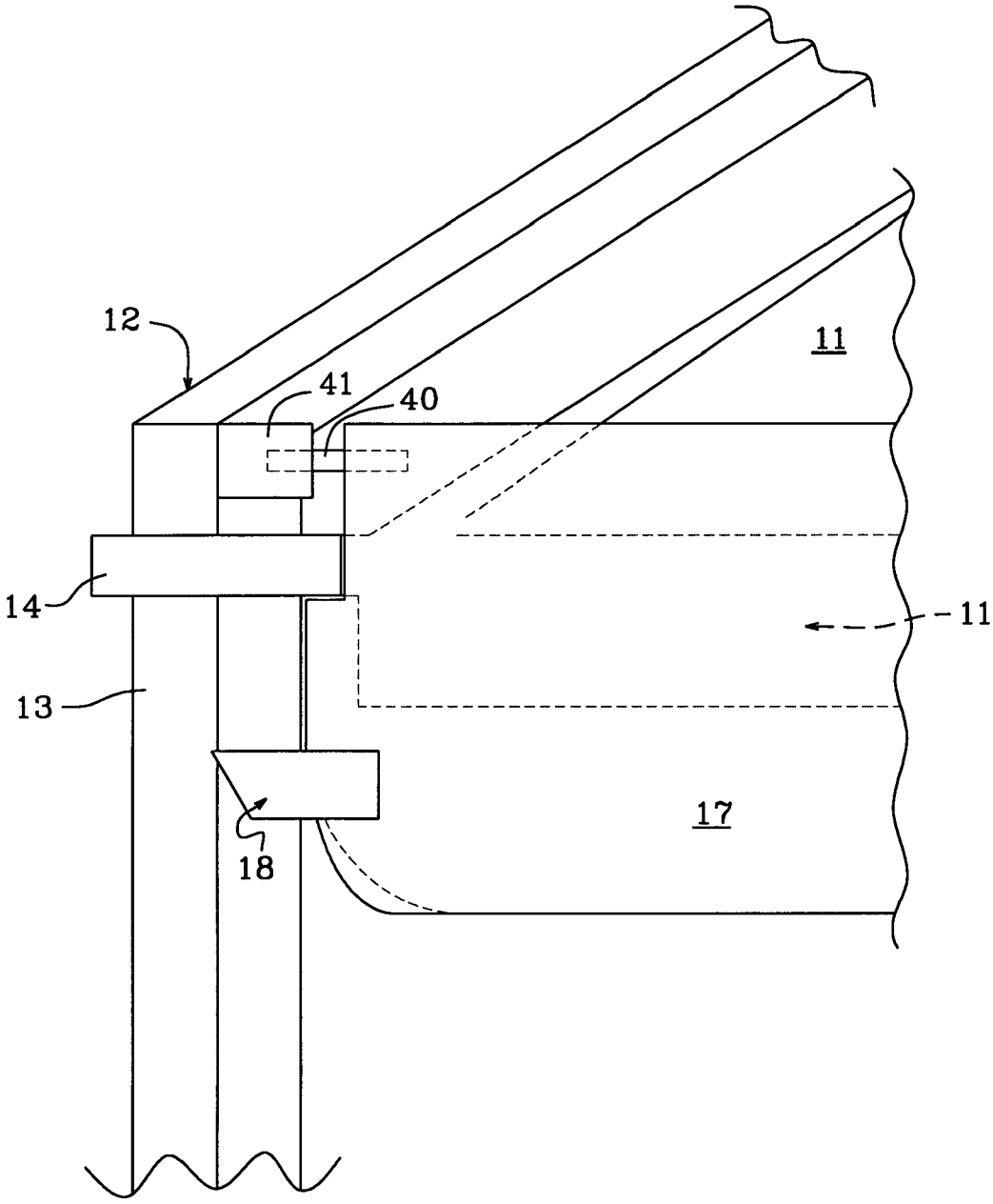
FIG. 4 depicts an enlarged view of one corner of the frame and louver as seen in FIG. 2 with the hood fully raised.

To lower hood 11 during periods of spa non-use, control panel 36 operates louver drive 19 which includes drive wheel 20 and drive wheel plate 25 seen enlarged in FIG. 3. Drive linkage 21 includes curved linkage arms 22 also shown in FIG. 3 positioned between drive wheel base 42 and drive wheel plate 25. Curved linkage arms 22 are each pivotably joined to different horizontal linkage arms 23 which in turn are each pivotably joined to different elongated linkage arms 24. Each linkage arm 24 is pivotably joined to different louvers 17 by clevis 26 affixed thereto. Rigid u-shaped shafts 44 (FIG. 2) each pass through different elongated linkage arms 24 and are affixed to frame 12 via pillow blocks 45 mounted on hood frame 12.

In use, from control panel 36, the operator activates electric louver motor 29 (FIG. 2) which in turn rotates motor shaft 30 joined thereto as seen in FIG. 3. Pinion 28 is rigidly affixed to motor shaft 30 and is engaged with drive wheel rack 27. Louver motor 29 is reversible to allow pinion 28 to turn louver drive wheel 20 directionally as required. Rack 27 is integrally formed with drive wheel 20 as shown enlarged in FIG. 3. Drive wheel 20 is rotatably supported by base 42 on hood frame 12 as shown in FIGS. 1 and 2. As drive wheel 20 turns in a first direction, curved linkage arms 22, horizontal linkage arms 23, elongated linkage arms 24 and clevises 26 are set in motion to raise louvers 17. Further, as shown in FIG. 1, as drive wheel 20 rotates in a counterclockwise direction, louvers 17 raise as u-shaped shafts 44 rotate towards drive wheel plate 25 in FIGS. 1, 2 and 3. Once louvers 17 have pivoted outwardly, brackets 14 are then free to move downwardly along posts 13 to lower hood 11 over spa 50.

In order to provide greater privacy during use of spa 50, a series of spring loaded curtains 60 (shown in FIG. 1) are affixed to each louver 17. Alternate forms of curtains 60 may be used such as opaque, transparent or translucent as desired. As an alternative to curtain 60, closable Venetian blinds may also be suspended from louvers 17 and operated as desired. As hereinbefore mentioned curtain 60 could be motorized as conventional and operated from control panel 36.

In the preferred method of operating spa cover 10, electric winch 15 is activated by pressing an appropriate control button on control panel 36. This activation causes cable 16 to wind on winch pulley 35, raising hood 11. Brackets 14 eventually contact bracket guides 18 (FIG. 2) forcing louvers 17 outwardly to allow brackets 14 to pass by bracket guides 18. A limit switch (not shown) can then operate to terminate power to winch 15. Spa 50 is then available for use.

After spa use, control panel 36 is then used to activate louver motor 29 which in turn operates louver drive 19 causing louvers 17 as previously explained to pivot outwardly once again. Once louvers 17 are directed outwardly away from posts 13, winch 15 is then activated through control panel 36 to unwind cable 16, allowing hood 11 to lower and contact spa 50. Hood 11 is then in a closed posture on spa 50, preventing dirt, dust, debris, leaves and the like from entering spa 50 and contaminating the water therein.

The illustrations and examples provided herein are for explanatory purposes and are not intended to limit the scope of the appended claims.

I claim:

1. A spa cover for selectively raising and lowering comprising: a hood, a plurality of brackets, said plurality of brackets attached to said hood, a hood frame, said hood frame comprising a plurality of vertical posts, each of said plurality of brackets slidably affixed to different ones of said plurality of vertical posts, an electric winch, said electric winch mounted on said hood frame over said hood, a cable, said cable windable about said electric winch, said cable affixed directly to the center of said hood, a control panel, said control panel in communication with said electric winch whereby said hood can be raised and lowered by said control panel.

2. The spa cover of claim 1 further comprising a series of louvers, a series of axle pairs, said axle pairs joined to different louvers, each of said series of louvers pivotably joined to said hood frame by different axle pairs, a louver drive, said louver drive comprising a drive wheel plate, said drive wheel plate defining an aperture, said cable passing through said aperture, said louver drive connected to said series of louvers, a plurality of bracket guides, said plurality of bracket guides each attached to different ones of said series of louvers, said bracket guides for engaging said plurality of brackets to pivot said series of louvers outwardly as said hood is raised and said bracket guides to secure said hood in a raised posture with said plurality of bracket guides proximate different vertical posts.

3. The spa cover of claim 2 wherein said louver drive further comprises a louver motor, a pinion, said pinion connected to said louver motor, a louver drive wheel, said louver drive wheel mounted on said hood frame, a rack, said rack affixed to said louver drive wheel, said pinion meshed with said rack, whereby said louver motor will turn said pinion in one direction to pivot outwardly said series of louvers to allow said hood to descend and will turn said pinion in an opposite direction to pivot inwardly said series of louvers after said hood has descended.

4. The spa cover of claim 3 further comprising louver linkages, said louver linkages affixed to said series of louvers and to said louver drive wheel to pivot said series of louvers.

5. The spa cover of claim 3 further comprising a control panel, said control panel in communication with said louver motor for operating said louver motor.

6. A method of operating a spa cover comprising the steps of:

a) providing a spa cover having a hood frame with a plurality of posts, the hood frame supporting an electric winch with a cable, the winch positioned in the center of the hood frame, a hood, the hood having a series of brackets with each bracket surrounding a different post, the cable attached directly to the center of the hood, and a louver motor for operating a series of louvers pivotally attached to the hood frame;

b) activating the electric winch to wind the cable and raise the hood;

c) allowing the brackets to pivot the louvers outwardly;

d) continuing raising the hood until the brackets clear the louvers; and e) allowing the louvers to pivot inwardly to secure the hood in a raised position.

7. The method of claim 6 further comprising the steps of pivoting the louvers outwardly by rotating the louvers around louver axles to allow the hood to be lowered.

8. The method of claim 7 where pivoting the louvers outwardly comprises the step of pivoting the louvers by operating the louver motor.

* * * * *